US007524246B2

(12) United States Patent
Briggs et al.

(10) Patent No.: US 7,524,246 B2
(45) Date of Patent: Apr. 28, 2009

(54) INTERACTIVE CHALLENGE GAME SYSTEMS AND METHODS

(75) Inventors: Rick A. Briggs, Springfield, IL (US); Jonathan A. Barney, Newport Beach, CA (US); Denise Chapman Weston, Wakefield, RI (US); Edward J. Frantz, Nehalem, OR (US)

(73) Assignee: Creative Kingdoms, LLC, Wakefield, RI (US)

( * ) Notice: Subject to any disclaimer, the term of this patent is extended or adjusted under 35 U.S.C. 154(b) by 367 days.

(21) Appl. No.: 11/376,570

(22) Filed: Mar. 15, 2006

(65) Prior Publication Data

US 2006/0229134 A1 Oct. 12, 2006

Related U.S. Application Data

(60) Provisional application No. 60/663,341, filed on Mar. 17, 2005.

(51) Int. Cl.
*A63H 23/10* (2006.01)

(52) U.S. Cl. ..... 472/128; 463/67; 273/440

(58) Field of Classification Search ..... 472/128, 472/129, 136, 137; 463/67–69; 273/440, 273/441, 459, 108, 118 R, 118 A
See application file for complete search history.

(56) References Cited

U.S. PATENT DOCUMENTS 2,001,366 A * 5/1935 Mittelman ..... 273/144 R
3,135,512 A 6/1964 Taylor
4,055,341 A * 10/1977 Martinez ..... 463/69
4,153,250 A * 5/1979 Anthony ..... 463/69
4,175,665 A 11/1979 Dogliotti
4,595,369 A 6/1986 Downs
4,932,917 A * 6/1990 Klitsner ..... 463/69
5,114,344 A 5/1992 Fumagalli et al.
5,194,048 A 3/1993 Briggs
5,378,197 A 1/1995 Briggs
5,393,074 A * 2/1995 Bear et al. ..... 273/440
5,421,575 A 6/1995 Triner
5,443,261 A * 8/1995 Lee et al. ..... 273/445
5,452,893 A * 9/1995 Faulk et al. ..... 463/68
5,482,510 A 1/1996 Ishii et al.
5,580,319 A 12/1996 Hamilton (Continued)

OTHER PUBLICATIONS

Digital ID Cards The next generation of 'smart' cards will have more than a one-track mind. Wall Street Journal, Jun. 25, 2001.

*Primary Examiner*—Kien Nguyen
(74) *Attorney, Agent, or Firm*—Knobbe, Martens, Olson & Bear, LLP

(57) ABSTRACT

A method of competitive game play is provided utilizing a plurality of balls or other discrete play media. Balls may be tagged or otherwise identified with a differentiating color, size, weight, printed code or other identification/tracking means, as desired. The game is configured such that individual play participants or groups of play participants (e.g., boys vs. girls) can effectively compete with other players or groups of players within the same game based on interactions with various game inputs distributed throughout the game system. The game inputs advantageously enable players to selectively control or direct ball movement and/or other play media movement to various desired collection areas, scoring areas, targets and/or the like. Play participants competitively play and interact with the gaming system and/or with one another to achieve desired goals and/or produce desired effects.

20 Claims, 10 Drawing Sheets

U.S. PATENT DOCUMENTS 5,649,867 A 7/1997 Briggs
5,662,525 A 9/1997 Briggs
5,667,217 A * 9/1997 Kelly et al. ..... 273/126 R
5,741,189 A 4/1998 Briggs
5,836,817 A 11/1998 Acres et al.
5,853,332 A 12/1998 Briggs
5,855,483 A 1/1999 Collins et al.
5,865,680 A 2/1999 Briggs
5,924,695 A 7/1999 Heykoop
5,942,969 A 8/1999 Wicks
5,967,901 A 10/1999 Briggs
6,089,987 A 7/2000 Briggs
6,129,549 A 10/2000 Thompson
6,132,318 A 10/2000 Briggs
6,174,242 B1 1/2001 Briggs et al.
6,210,287 B1 4/2001 Briggs
6,220,965 B1 4/2001 Hanna et al.
6,231,451 B1 5/2001 Briggs
6,234,803 B1 5/2001 Watkins
6,254,101 B1 7/2001 Young
6,264,202 B1 7/2001 Briggs
6,273,425 B1 8/2001 Westfall et al.
6,276,353 B1 8/2001 Briggs et al.
6,283,871 B1 9/2001 Briggs
6,352,478 B1 3/2002 Gabai et al.
6,375,578 B1 4/2002 Briggs
6,386,538 B1 * 5/2002 Mejia ..... 273/118 R
6,527,646 B1 3/2003 Briggs
6,569,023 B1 5/2003 Briggs
6,634,949 B1 10/2003 Briggs et al.
6,682,074 B2 1/2004 Weston
6,725,107 B2 * 4/2004 MacPherson ..... 700/92
6,746,334 B1 6/2004 Barney
6,761,637 B2 7/2004 Weston et al.
6,786,830 B2 9/2004 Briggs et al.
6,796,908 B2 9/2004 Weston
6,967,563 B2 11/2005 Bormaster
6,967,566 B2 11/2005 Weston et al.
7,029,400 B2 4/2006 Briggs
2002/0032067 A1 3/2002 Barney
2004/0033833 A1 2/2004 Briggs et al.
2004/0077423 A1 4/2004 Weston et al.
2004/0204240 A1 10/2004 Barney
2005/0143173 A1 6/2005 Barney et al.

* cited by examiner 300D
330
BOYS
46
TIME
52
GIRLS
38
WIN
WIN
160
340
110
120
105
105
115
s1
s2
M

INTERACTIVE CHALLENGE GAME SYSTEMS AND METHODS

RELATED APPLICATION

This application claims priority under 35 U.S.C. § 119(e) to U.S. Provisional Application No. 60/663,341, filed Mar. 17, 2005, which is hereby incorporated herein by reference in its entirety.

BACKGROUND OF THE INVENTION

1. Field of the Invention

The present invention relates to children's games and play structures and, in particular, to interactive games and play systems utilizing balls and similar discrete objects as an interactive play medium to provide a unique interactive game play experience.

2. Description of the Related Art

Family entertainment centers, play structures and other similar facilities are well known for providing play and interaction among play participants playing in, or around, an entertainment facility and/or play structure. For example, U.S. Pat. Nos. 5,853,332, 5,865,680 each to Briggs, each of which is hereby incorporated herein by reference in its entirety, disclose interactive games. A wide variety of commercially available play toys and games are also known for providing valuable learning and entertainment opportunities for children, such as role playing, reading, memory stimulation, tactile coordination, and the like.

However, there is always a demand for more exciting and entertaining games and play systems that increase the learning and entertainment opportunities for children and stimulate creativity and imagination.

SUMMARY OF THE INVENTION

The present invention, in one embodiment, provides a unique method of competitive game play carried out within either an existing or specially configured entertainment facility, free-standing gaming device or play structure. The game utilizes a plurality of balls or other suitable discrete play media preferably tagged or otherwise identified with a differentiating color, size, weight, printed code and/or other identification/tracking means. The game is configured such that individual play participants or groups of play participants (e.g., boys vs. girls) can effectively compete with other players or groups of players based on interactions with various game inputs distributed throughout the game system. The game inputs advantageously enable players to selectively control or direct ball movement and/or other play media movement to various desired collection areas, scoring areas, targets and/or the like. The play environment is preferably physical and tangible so as to encourage both physical and social interactivity, but it may also be wholly or in part computer-generated or virtual, as desired. Play participants competitively play and interact with the gaming system and/or with one another to achieve desired goals and/or produce effects.

In an embodiment, a competitive game play system is disclosed that is configured such that a play participant competes with at least one other play participant within the same game. The game play system comprises a play structure having a plurality of predetermined paths; a plurality of discrete play media; and at least one game input device in communication with the play structure, whereby the at least one game input device enables play participants to selectively activate controls that transport the plurality of discrete play media through at least one predetermined path of the play structure to at least one desired destination.

In certain embodiments, a game play system is disclosed for facilitating interactive play. The game play system includes a play structure having a plurality of predetermined paths and a plurality of discrete play media. The game play system also includes at least one game input device in communication with the play structure, whereby the at least one game input device enables at least one play participant to selectively activate controls that transport the plurality of discrete play media through at least one of the plurality of paths to at least one destination.

In an embodiment, a method of competitive game play for play participants is disclosed. The method includes receiving substantially simultaneous access by a plurality of play participants to a play system, wherein the play system comprises at least one game input, a plurality of discrete play media, and at least one desired destination for the discrete play media. The method further includes receiving at least one control signal from the at least one game input to affect the transport of the plurality of discrete play media through at least one predetermined path of the play system to the at least one desired destination. The method further includes determining a success of the play participants based on the transport of the plurality of discrete play media to the at least one desired destination.

In an embodiment, a method of competitive game play for play participants is disclosed. The method includes accessing a play system, wherein the play system comprises a plurality of discrete play media and at least one game input configured to enable players to substantially simultaneously selectively control transport of the plurality of discrete play media through the play structure to at least one desired destination. The method further includes utilizing the at least one game input to selectively control the transport of the plurality of discrete play media to the at least one desired destination.

In another embodiment, a method of competitive game play is disclosed. The method comprises providing a plurality of discrete play media identified with at least one of a differentiating color, size, weight, and printed code, the game being configured such that play participants compete with each other within the same game based on interactions with various game inputs distributed throughout the game system, and whereby the game inputs enable the play participants to selectively control or direct movement of the plurality of discrete play media to various desired destinations to produce at least one effect.

For purposes of summarizing the invention and the advantages achieved over the prior art, certain objects and advantages of the invention have been described herein above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

DETAILED DESCRIPTION OF THE PREFERRED EMBODIMENTS

Basic Game System

All embodiments disclosed herein are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

Figure 1:
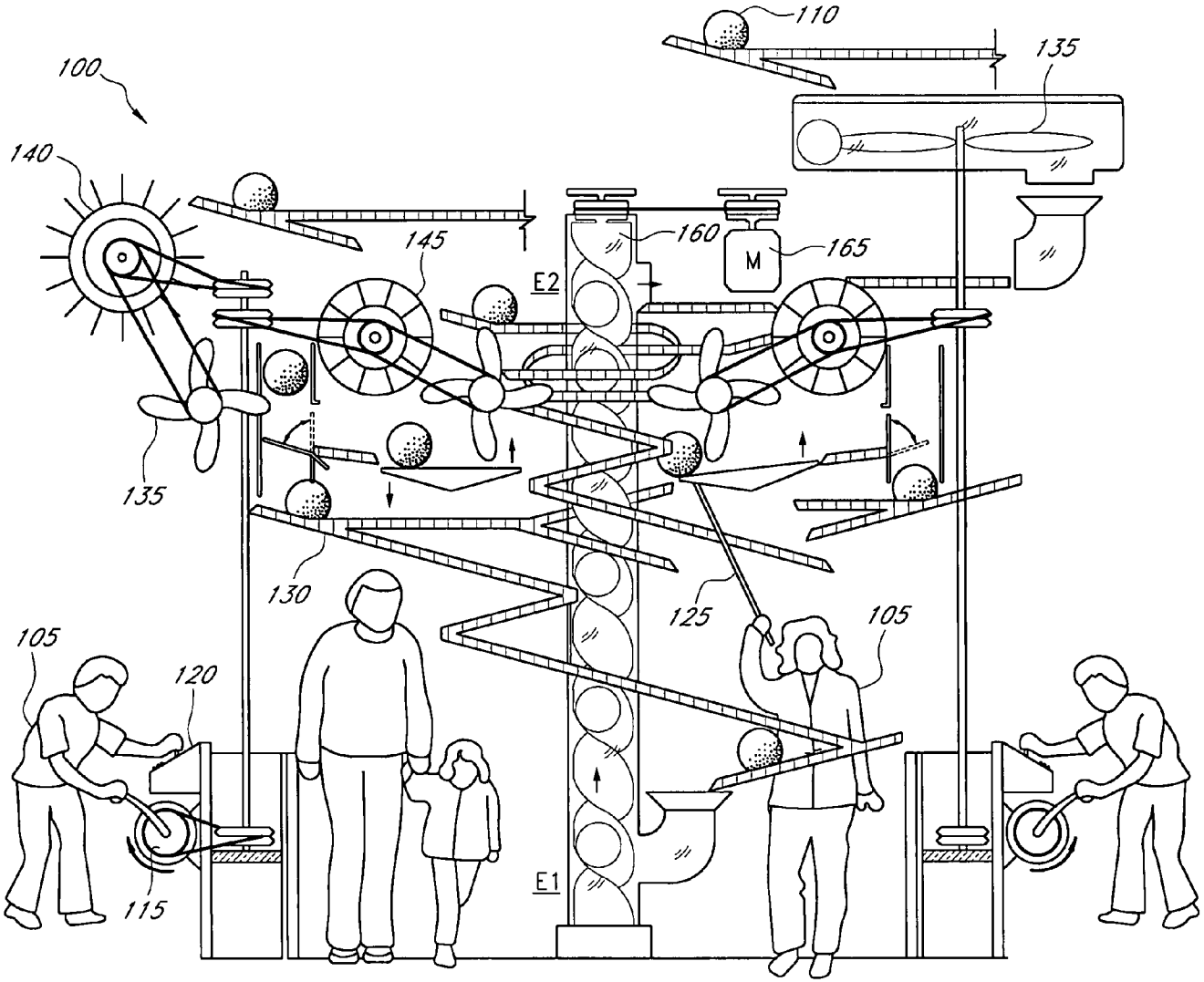
FIG. 1 is a front elevation view of an embodiment of an interactive ball challenge game incorporating certain features and advantages in accordance with the present invention.

FIG. 1 illustrates an embodiment of an interactive ball challenge game system 100. The illustrated game system 100 comprises a large walk-through structure configured in the general theme or form of a Rube-Goldberg "do-nothing" contraption. The game system 100 comprises a complex and convoluted structure with many interesting visual, aural, and tactile effects primarily involving the active and/or passive movement of a multitude of contained balls 110 and/or other suitable discrete play media. While a Rube Goldberg theme is preferred in this particular example, a wide variety of other themes and thematic elements may also be used with equal efficacy, including but not limited to a giant gumball machine, pinball machine, ant hill, bee hive or other insect nest, fruit conveyer, fruit juicing machine, hen house with egg-laying hens, combinations of the same, and the like.

Preferably, in one embodiment, the game system 100 is fully or substantially incorporated into and/or integrated with a play structure including multiple elevated platforms or play areas and any number of other (passive or active) play elements, such as climbing nets, crawl tunnels, swinging bridges, slides, and the like. These provide entertaining physical challenges and allow play participants to safely negotiate their way through the various areas of the game. Most preferably, in certain embodiments, one or more "reward" slides are provided at the front, rear, and/or sides of the play structure and may be straight, curved, or spiral-shaped, as desired. These may be enclosed and tube-like or open and exposed. Reward elements, in certain embodiments, are preferably access-restricted and/or are configured to provide varying levels of enjoyment depending upon the number of points or other credits earned by play participants playing the game. In this manner, play participants are encouraged to play the game to earn ever greater or more plentiful rewards. Alternatively, those skilled in the art will readily appreciate that the size, number, and location of slides or other "reward" elements can be varied greatly, as desired, while still enjoying the benefits and advantages of the present invention.

In one embodiment, the play structure itself preferably comprises a multi-level enclosure or structure constructed using any one of a number of materials and construction techniques well known to those skilled in the art. A simple, single level structure is illustrated in FIG. 1 for sake of clarity and ease of understanding of the invention and is not intended to be limiting in any way on the scope of the invention herein disclosed. The structure may be configured for either outdoor or indoor use, as desired. Preferably, the structure comprises a more-or-less open supporting framework formed from a plurality of interconnected support members comprising columns, pylons, beams, connectors, and the like. Support members may be formed from any combination of convenient materials having sufficient strength and durability for safely supporting the discrete play media and/or multiple play participants 105. For example, plastic or PVC pipes, steel pipes, I-beams or channel beams, reinforced concrete beams/columns, combinations of the same, and the like may all be used to form a suitable supporting framework.

For visual appeal and added safety, optional decorative panels, railings and/or roofing elements may be provided, as desired, to shade play participants 105 from the sun (for outdoor play structures), to prevent play participants 105 from falling off the structure, and/or to complement a particular desired theme. Decorative panels may be formed of wood, fiberglass or other reinforced fiber, PVC, aluminum, steel, or a variety of other suitable materials, as desired. Corrosion-resistant materials are preferred, particularly if the play structure is to be used outdoors. Of course, those skilled in the art will readily appreciate that a wide variety of other decorative or thematic elements may be incorporated into the overall design of the play structure in order to provide added safety and/or to help convey a particular desired play theme.

A number of tracks 130, predetermined paths, runnels, conduits and/or other transport means are preferably provided throughout the game system 100 for transporting play media to and from various play areas within the game system 100. In certain embodiments, the tracks 130 may be formed from plastic hosing or PVC pipes joined together using commercially available fittings, as is well known in the art. Suitable tracks or conduits may also be formed from a wide variety of other suitable materials such as steel pipe, ceramic/clay pipe, or they may be formed as open channels and/or runners, as desired. In one embodiment, clear or colored/transparent plastic pipes having an inner diameter of about 2.1 inches to about 6.5 inches, and more preferably about 3 inches to about 4 inches, are particularly preferred for aesthetic appeal and added excitement. Alternatively, larger or smaller diameter conduits having different colors and/or shapes may be used, as desired, to accommodate various sizes and shapes of balls 110 or other play media. In certain embodiments, the tracks 130 are enclosed so as to substantially prevent removal or damage of balls 110 or other play media by play participants, although open tracks may also be used with efficacy, as illustrated in FIG. 1. Open or enclosed tubes, pipes, runnels or hoses may also be used to facilitate movement of balls 110 or other play media throughout the play system 100. Balls 110 or other play media may be conveniently transported by use of gravitational force, motorized conveyers, water/fluid, pressurized air, suction, or various other suitable means, as desired.

The game system 100 preferably includes a multitude of interactive game input devices, such as hand-crank 115, remote control switch-activation console 120, and pull-chain-operated tilt paddle 125. These devices are preferably arranged and configured throughout the game system 100 at various locations to enable play participants 105 to selectively control and/or alter the course of balls 110 or other play media as they course through the game. In this manner, play participants can learn and observe mechanical cause and effect relationships. In certain embodiments, play participants can compete against other play participants or groups of play participants to achieve one or more desired goals such as selective movement of balls or other play media to desired locations and/or to particular desired ball-activated effects within the game system 100.

In yet other embodiments, a solo play participant may participate in the game system 100. In such embodiments, the solo game participant may obtain a certain score or progress, such as an amount of points, that represents his or her success in the game. In certain embodiments, the solo game participant may redeem his or her points for a prize, such as a toy, a coupon or other like reward.

Various interesting dynamic visual, aural, and/or tactile effects such as pinwheels 135, paddle wheels 140, conveyer wheels 145, combinations of the same and the like, may be arranged and configured throughout the game system 100 to entertain and stimulate curiosity and imagination of play participants as they operate the various interactive inputs and observe the resulting effects. Preferably, some or all of these dynamic visual, aural, and/or tactile effects are ball-activated or ball operated in that they preferably produce a desired effect whenever a play participant is successful in directing one or more balls to the effect. At least one ball lift 160 or ball elevator may be provided and configured to transport balls 110 or other play media from lower elevations to higher elevations. A motorized cork-screw ball lift 160 may also be driven by a suitable motor 165 and configured to continuously transport balls from at least one lower elevation to at least one higher elevation in order to provide more-or-less continuous movement and supply of balls throughout the game system 100. Alternatively, one or more hand-operated ball lifts or elevators may be provided in addition to, or instead of, motorized ball lift 160 in order to provide additional interactivity and competitive challenge to the game.

While a particular preferred play environment and play structure 100 has been described, it will be readily apparent to those skilled in the art that a wide variety of other possible play environments, play structures, entertainment centers and the like may be used to create an interactive play environment within which the invention may be carried out. For instance, a suitable play structure may be constructed substantially entirely of molded or contoured concrete, fiberglass or plastic, as desired. Alternatively, a suitable play structure may be constructed entirely or partially from conduits or pipes which also transport play media to and from various locations throughout the play structure. Alternatively, the play environment need not comprise a play structure at all, but may be simply a themed play area, or even a multi-purpose area such as a restaurant dining facility, family room, bedroom, or the like. In yet other embodiments, at least one game input device may include a computer-controlled device.

Play Media

Preferably, a suitable easily transported play media, such as foam, rubber, or plastic balls or similar discrete play objects, is provided for use throughout the game system to provide a dynamic interactive play experience. The particular game system illustrated in FIG. 1 utilizes a plurality (e.g., hundreds or thousands) of hard plastic balls as an interactive play medium. These may be manipulated by play participants 105 using one or more of the various interactive input devices to create desired dynamic effects. In one embodiment, balls may range in size from approximately 1 inch to approximately 12 inches in diameter or larger, as desired, and are preferably about 6 inches to about 8 inches in diameter. If open tracks are used, preferably the balls are not so small as to present a choking hazard for young children. The majority of the balls may be the same size or, more desirably, a mixture of ball sizes may be utilized for greater interest and diversity of effects. A few play elements, as described below, may utilize balls of a relatively large diameter (about 12 inches or more). Certain play elements may use only certain sized balls, with filtering relays (not shown) in the various tracks 130 or conduits permitting only certain sized balls to roll to certain areas within the game system. A range of colors for the balls may also be used for visual appeal and variety of effects. Optionally, ball sizes and/or types may be selected and used as desired to indicate various point or scoring levels and/or to indicate use in specific desired associated play zones.

Other suitable play media may include, without limitation, foam, plastic or rubber balls and similarly formed articles such as cubes, plates, flying discs, tubes, cones, rubber or foam bullets/arrows, or the like, the present invention not being limited to any particular preferred play media. These may be used alone or in combination with one another. Wet or semi-wet play mediums, such as slime-like materials, snow, and/or water balloons may also used, as desired, to cool and entertain play participants. Durable plastic or rubber play media are particularly preferred in an outdoor play structure where environmental exposure may prematurely destroy or degrade the quality of certain play mediums such as foam balls. The particular play media selected is not critical to carrying out the invention and, optionally, may be omitted altogether such as in the case of a virtual or computer generated version of the game.

Figure 2A:
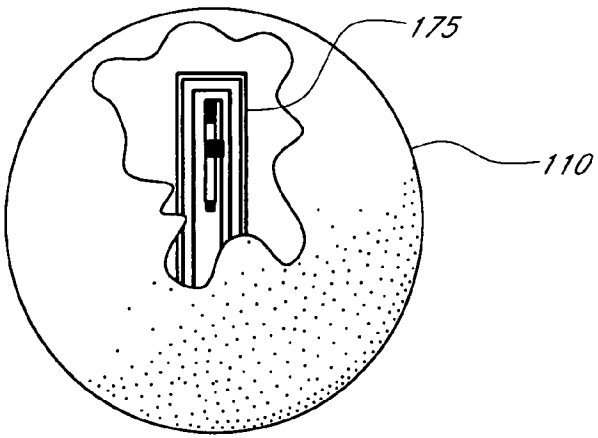
FIGS. 2A-2D are exemplary illustrations of several possible tagging/identification options for selectively identifying or differentiating balls and/or other play media as may be desired for use in various embodiments of the invention disclosed herein.

Preferably (although not required), some of all of the balls 110 or other play media are tagged or otherwise configured so as to be capable of electronic and/or wireless identification by certain elements of the game system. For example, certain balls or play media may contain unique tags and/or markings that enable them to be electronically sensed or identified as they pass over or through certain components of the game system. FIGS. 2A-2D illustrate several possible ball tagging/identification alternatives having particular advantages for use in accordance with the present invention. FIG. 2A illustrates the preferred use of an embedded wireless radio frequency identification (RFID) tag 175 contained within each ball 110. RFID tags provide a wireless link to uniquely identify objects or people. It is sometimes called dedicated short range communication (DSRC). RFID systems include electronic devices called transponders or tags, and reader electronics to communicate with the tags. These systems communicate via radio signals that carry data either uni-directionally (read only) or, more preferably, bi-directionally (read/write).

In yet other embodiments, one or more of the play media may be bar-coded or marked in another like manner to facilitate electronic identification and/or tracking by the game system.

Preferably, in certain embodiments, the selected tag 175 is passive (requires no batteries) so that it is inexpensive to purchase and maintain, though it is recognized that other tags 175 may be used. Such tags and various associated readers and other accessories are commercially available in a wide variety of configurations, sizes and read ranges. RFID tags having a read range of between about 10 centimeters to about 100 centimeters are particularly preferred, although shorter or longer read ranges may also be acceptable. The particular tag illustrated is the 13.56 MHz tag sold under the brand name Taggit™ available from Texas Instruments, Inc. (http://www.tiris.com, Product No. RI-103-110A). This particular tag has a useful read/write range of about 25 centimeters and contains 256-bits of on-board memory arranged in 8×32-bit blocks, which may be programmed (written) and read by a suitably configured read/write device. If a longer read/write range and/or more memory is desired, optional battery-powered tags may be used instead, such as available from ACXESS, Inc., and/or various other vendors known to those skilled in the art.

Figure 2B:
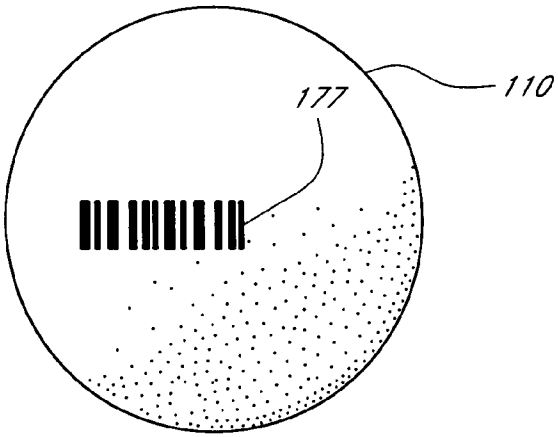
Figure 2C:
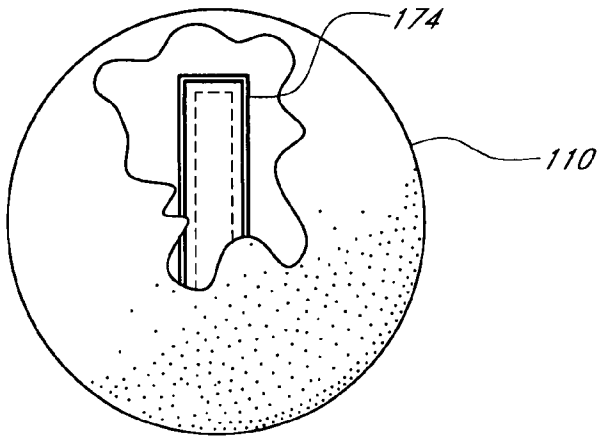
Figure 2D:
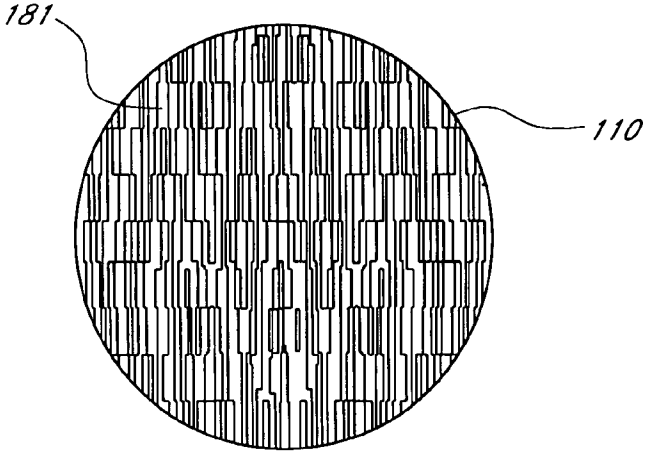

FIG. 2B illustrates the use of a unique bar code identifier 177 imprinted on an outer surface of the ball 110 and can be used with conventional bar-code readers. FIG. 2C shows the use of an embedded electronic article surveillance (EAS) tag 179, such as a magnetic resonance tag, magneto-acoustic tag, scatter tag or the like which can be used with article surveillance detectors. FIG. 2D illustrates the use of a unique electronically-readable pattern 181 or bar-coding covering essentially the entire outer surface of the ball. Those skilled in the art will readily appreciate how these and other similar object identification techniques may advantageously be used and implemented within the context of an interactive ball challenge game as set forth herein. For example, U.S. Pat. No. 6,761,637 to Weston et al., and U.S. Patent Publication No. 2002-0193047 A1 to Weston, each of which is hereby incorporated by reference in its entirety as though fully reproduced herein, discloses certain object identification techniques.

Alternatively, non-tagged balls 110 may also be used in accordance with various alternative embodiments of the invention. In the case of non-tagged balls point scoring and object differentiation can be provided with simple sensors such as micro-switches, beam sensors, ultrasonic sensors, color sensors, object shape/size filters, combinations of the same, and the like.

Game Play and Operation

Figure 3:
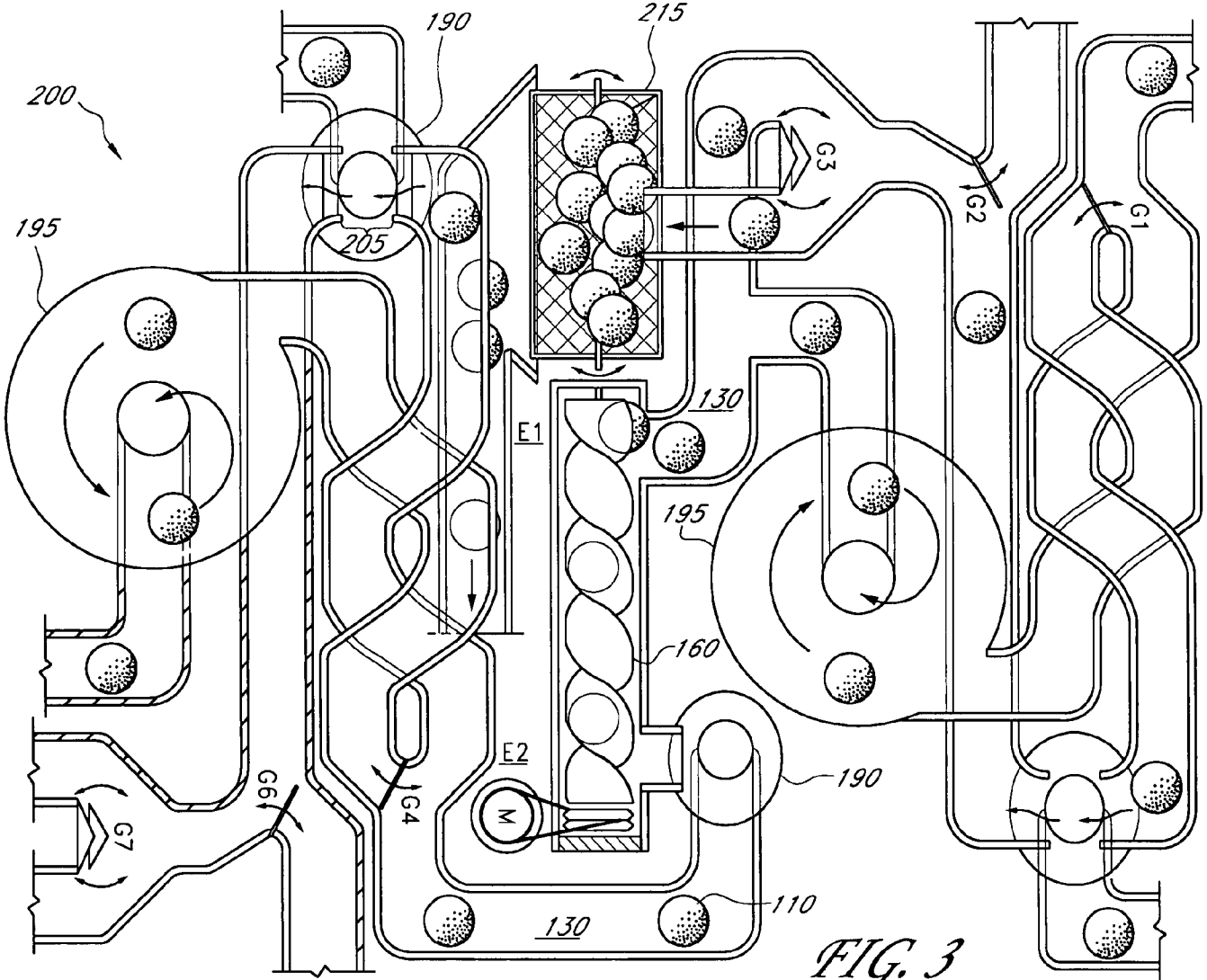
FIG. 3 is a top plan view of an alternative embodiment of an interactive ball challenge game, including a motorized ball lift, downward sloped tracks or runnels, switches, ball funnels and a dumping basket.

Basic game play and operation is described primarily with reference to the two alternative embodiments of the invention illustrated in FIGS. 1 and 3. For convenience of description and ease of understanding, similar or identical reference numbers are used throughout to designate similar elements and should not be construed as limiting the scope of the invention in any way. As best illustrated in FIG. 1, balls 110 are continuously conveyed by motorized ball lift 160 from a lower elevation E1 to a higher elevation E2. At the higher elevation E2, balls 110 are delivered onto a track 130 and are drawn by gravity along various twists and turns and through various effects, gates and/or switching elements G1-G7 (FIG. 3). Effects may include, for example, pin wheels 135, paddle wheels 140, conveyer wheels 145, combinations of the same, and the like. These are preferably selected and configured to provide interesting visual, aural, and/or tactile stimulation.

Preferably, at least some of the gates or switching elements are adapted to be controlled or activated by play participants 105 using one or more interactive input devices, such as illustrated in FIG. 1. For example a hand-crank 115, remote control switch-activation console 120, or pull-chain-operated tilt paddle 125 can be used by play participants 105 to selectively control and/or alter the course of the balls 110 or other play media as they course through the game and along the track 130. In this manner, play participants can learn and observe mechanical cause and effect relationships and can compete against other play participants or groups of play participants to achieve a desired movement of balls or other play media to certain desired locations or to particular desired ball-activated effects within the game system. Some interactive input devices may have simple immediate effects, while others may have complex and/or delayed effects. Some input devices may produce local effects while others may produce remote effects.

Each play participant 110, or sometimes a group of play participants working together, preferably experiments with the various input devices in order to discover how to create the desired effect(s). Once one play participant figures it out, he or she can use the resulting play effect to surprise and entertain other play participants. Yet other play participants will observe the activity and will attempt to also figure it out in order to turn the tables on the next group. Optionally, play participants can compete with one another using the various play elements to see which participant or group of participants can create bigger, longer, more accurate, or more spectacular effects. For example, a suitable game can be configured as a competition between boys and girls. Each group occupies a certain position within the game and/or associated play structure and competes to activate the necessary gate(s) to move balls to their respective side. The group that accumulates the most balls on their side within an allotted time wins the game and receives the biggest reward (e.g., a quick celebration/victory dance with music).

Referring to FIG. 3, ball lift 160 lifts balls 110 from lower elevation E1 to higher elevation E2. At the higher elevation E2, balls 110 are deposited into a small funnel 190 and delivered to a track 130. Track 130 is preferably at least slightly tilted in a sufficient amount so as to provide gravity-induced motion of the balls 110. Balls 110 flow downwardly along the track 130 eventually reaching gate G4. Gate G4 is preferably directly and/or remotely activated or controlled by one or more play participants using a suitable input device such as a lever, a pull chain, and/or a remote-control console 120 (FIG. 1). The position of the gate G4 is thereby selectively determined by one or more play participants 105 who effectively direct the direction of ball travel either to a right or left branching portion of the track 130. Depending on the choice, the ball 110 either follows along a path leading to either another small funnel 190 discharging to another portion of the game (not shown) or to a large funnel 195 where it spirals around and around eventually discharging to a different portion of the game (not shown). If the former path is selected, the ball 110 has a further opportunity, depending on its particular velocity, to traverse over a jump 205, and thus avoiding draining into the small funnel 190. In that event, the ball 110 continues on the track 130 eventually reaching a gate G6. If gate G6 is rotated counter-clockwise, the ball 110 continues on track 135 to a different portion of the game (not shown). If the gate G6 is rotated clockwise, then ball 110 continues on the track 130 and eventually reaching tilt paddle G7. This may comprise a pull-chain activated tilt paddle 125 such as illustrated in FIG. 1, or it may comprise any one of a number of other tilt paddles or other track switches well known in the art. The position of tilt paddle G7 again determines the path of the ball as it continues to other portions of the game (not shown).

Incoming balls entering from other portions of the game system traverse along a similar path as selectively determined by play participants operating switches, gates, or tilt paddles G1-G3. One such path leads to another large funnel 195. Another path leads to a dumping basket 215 that periodically fills with balls and dumps over to another portion of track 130. Another path leads to back to the input side of the motorized ball lift at elevation El. Those skilled in the art will recognize the near infinite variety of game variations that can be realized using this or similar constructs.

If the balls 110 or other play media are tagged, preferably various tag readers and/or reader/writers ("readers") are distributed throughout the game system in those specific areas in which balls are desired to be identified. This may be useful, for example, where it is desired to track all or certain balls 110 or other play media for purposes of point scoring, providing variations in interactive effects, facilitating or encouraging sorting of balls by identified type, and/or the like. Depending upon the degree of game complexity desired and the amount of information sharing required, tag or bar-code readers may or may not be connected to a central computer system or database. In one particularly preferred embodiment, certain desired gaming information is stored directly on a read/write RFID tag associated with each tagged ball.

For example, in accordance with one particularly preferred embodiment, each ball 110 or other suitable play media is provided with an embedded read/write RFID tracking device that can be wirelessly tracked and/or communicated with using one or more associated RFID readers distributed throughout the game system. The tag is programmed with a unique object identifier number ("UOIN") identifying the type of ball and certain predefined characteristics, such as, for example, its point value and/or the like. The ball can further be temporarily or permanently selectively associated with a particular player or group of players whose points or performance characteristics are desired to be tracked. For example, each player in the game could be assigned a unique person identifier number ("UPIN") and an RFID and/or bar-coded card or wristband or the like that is used to track points in the game. Optionally, each group of players who desire to work together could be assigned a unique group identifier number ("UGIN") which may be used to track points or performance characteristics for the group.

During the course of play of the game, play participants may choose to have one or more balls or other objects "assigned" to them. For example, play participants may compete to coral a group of balls within a collection bin having an associated reader device. If the player chooses, he or she can request the reader to write the player's UPIN and/or UGIN onto each embedded RFID tag associated with each corralled ball. Alternatively, play participants may purchase preassigned balls from a ball vending machine or the like. Once a ball is "assigned" to a particular play participant or group, it can then be tracked by other readers throughout the game system for purposes measuring player performance and awarding points. Thus, players are able to compete on the basis of trying to operate the various input devices of the game to move specific tagged objects to specific desired locations within the game. Players may be awarded points for each player assigned ball that is caused to reach a certain area or target. Alternatively or in addition, players may compete to get as many balls as possible assigned to them or to their group so they will score more points or other rewards as the balls are used in the game. Individual and/or group scores may then be easily tracked and displayed on a scoreboard.

Game Tracking and Logic Control

Depending upon the degree of game complexity desired and the amount of information sharing required, optional readers and/or other ball sensors may or may not be connected to a computer control system, such as a central server. If a centralized system is utilized, preferably each ball contains a read/write RFID tag, and at least one suitable corresponding reader is provided throughout desired portions of the game system for electronically communicating information to/from each tag.

In an embodiment, a networked computer database is used to keep track of tagged balls and accord points to each associated play participant as appropriate. The information can be used for simple scoring purposes (e.g., updating a score board) or, in more complex variations, can be used to adjust the play experience for each player based on "knowing" where the player has been, what objectives that player has accomplished, and how many points or levels have been reached. For example, the system can allow or deny access to a player reward (e.g., a "reward" slide) based on how many points or levels have been reached by that player and/or based on what specific objectives the player has accomplished or helped accomplish.

Alternative variations the game can be implemented with no database and/or with a non-centralized database by using local processing contained in each reader and/or by directly storing any necessary relevant game information on each RFID tag or other information storage means associated with each tagged object and/or each player.

Alternative Game Variations

It should be readily apparent to those skilled in the art that an infinite variety fun and entertaining possibilities exist for configuring various alternative embodiments of an interactive ball challenge game system having features and advantages of the invention. It is impossible to describe all such possible variations; however, a few particularly preferred alternative embodiments are briefly described below.

Figure 4:
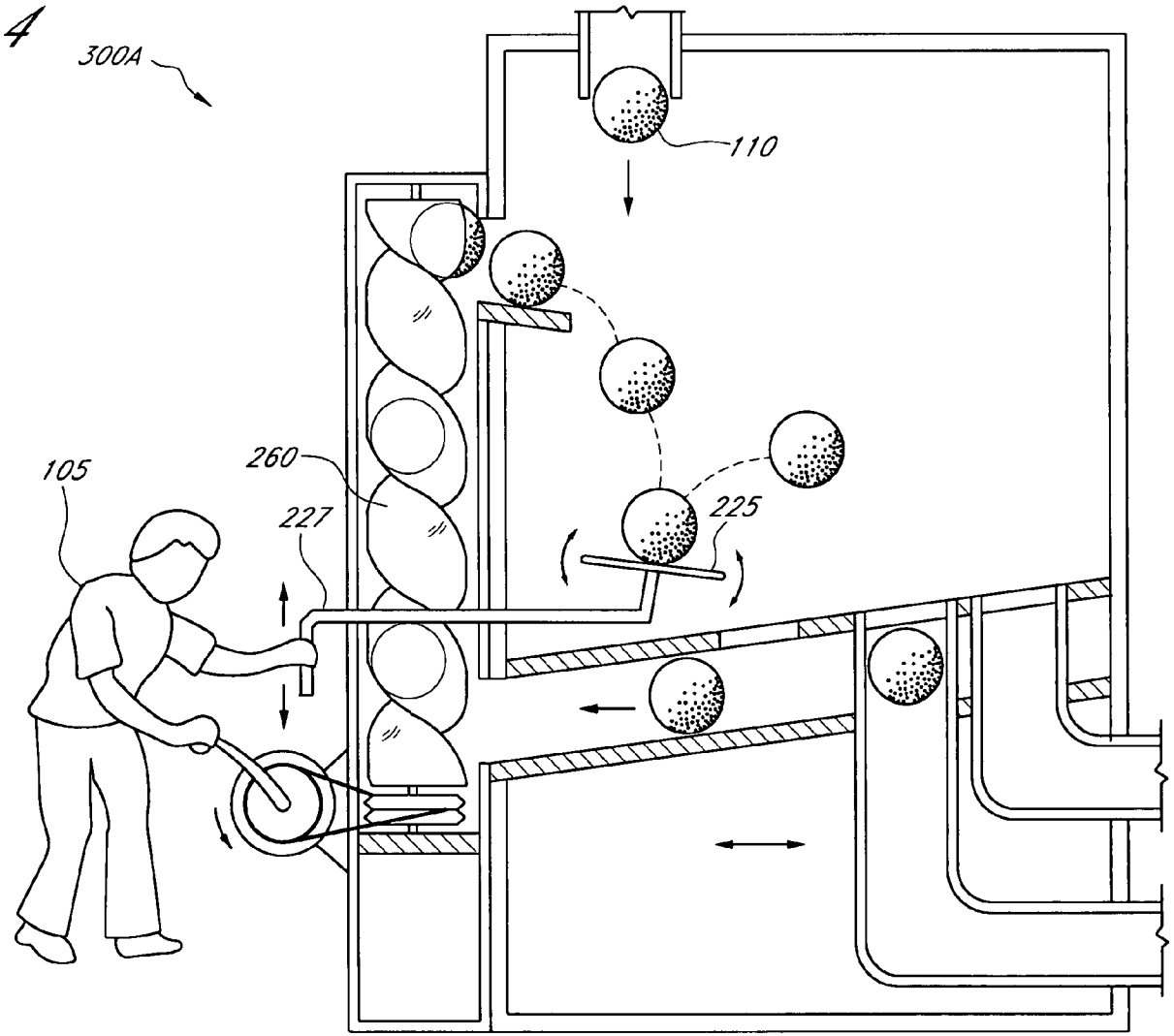
FIG. 4 is side partial elevation view of another alternative embodiment of an interactive ball challenge game, including a hand-operated ball lift and an interactive input device adapted to be operated by one or more play participants to selectively control or change the course of ball movement within the interactive ball challenge game.

FIG. 4 is side partial elevation view of an alternative embodiment of an interactive ball challenge game 300A incorporating features and advantages, including a hand-operated ball lift 260 and an interactive input device comprising a tilt paddle 225 configured and adapted to be operated by one or more play participants to selectively control or change the course of ball movement within the interactive ball challenge game. The tilt paddle 225 includes a handle 227 that may be selectively moved up or down and/or side-to-side by play participant 105 in an attempt to direct balls 110 into one of three different scoring holes. Preferably, balls passing through each hole are sensed using a conventional proximity or beam interruption sensor. Different amounts of points are accorded to the player depending on which scoring hole the ball enters.

Figure 5:
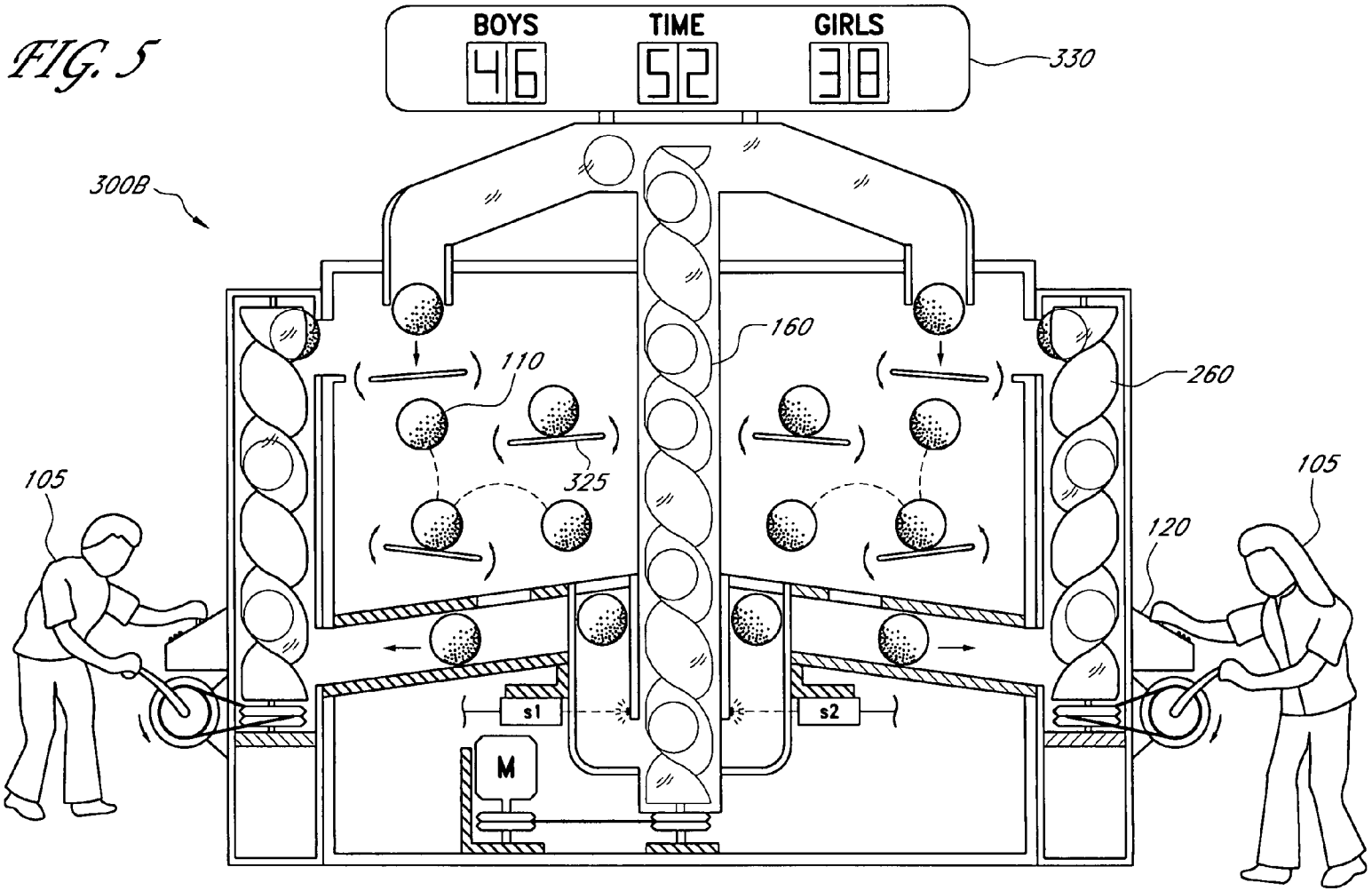
FIG. 5 is a side elevation view of an embodiment of an enclosed and self-contained head-to-head competitive interactive ball challenge game incorporating a motorized ball-lift, remote-operated tilt paddles, and automated scoring.

FIG. 5 is a side elevation view of a preferred embodiment of an enclosed and self-contained head-to-head competitive interactive ball challenge game 300B incorporating a motorized ball-lift 160, two hand-crank-operated ball lifts 260, a plurality of remote-operated tilt paddles 325, and automated scoring sensors s1 and s2. The game is preferably enclosed, and the balls are contained within clear Plexiglas walls. Opposing players attempt to direct balls 110 into specific desired scoring holes within an allotted time period using remote control console 120 to control each tilt paddles 325. In certain embodiments, points are accorded for each ball falling through the highest scoring hole but not for balls falling through the lowest hole. Players may also compete to recirculate balls that fall through the lowest hole using the hand-crank-operated ball lift 260. Elapsed time and points awarded may be displayed on an overhead scoreboard 330.

Figure 6:
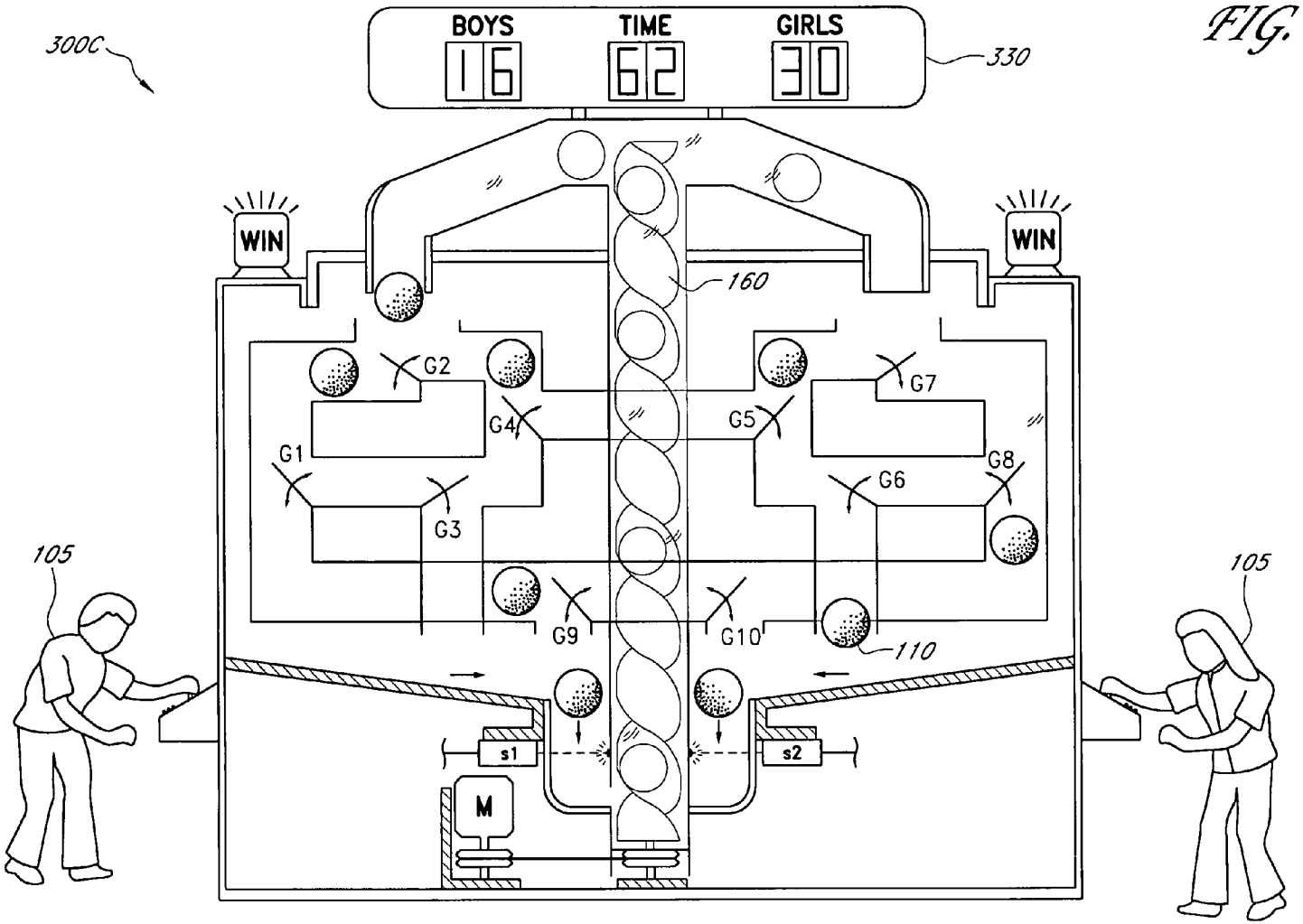
FIG. 6 is a side elevation view of an alternative embodiment of an enclosed and self-contained head-to-head competitive interactive ball maze challenge game incorporating a motorized ball-lift, remote operated switches, and automated scoring.

FIG. 6 is a side elevation view of an enclosed and self-contained head-to-head competitive interactive ball maze challenge game 300C incorporating a motorized ball-lift 160, remote operated gates G1-G10, and automated scoring sensors s1 and s2. In certain embodiments, the game is preferably enclosed, and the balls are contained within clear Plexiglas walls. Opposing players attempt to direct balls 110 through a maze into specific scoring holes for each side using remote control console 120 to control each gate G1-G10. Preferably, each player has the ability toggle all gates G1-G10 back and forth so each player must react quickly to changed gate settings in an attempt to direct each ball into that player's scoring hole. Points are accorded to each player according to the number of balls directed into each respective scoring hole. Optionally, each ball contains a unique identifier that is read by sensors s1 and s2 to accord different amounts of points per ball. Elapsed time and points awarded are displayed on an overhead scoreboard 330.

Figure 7:
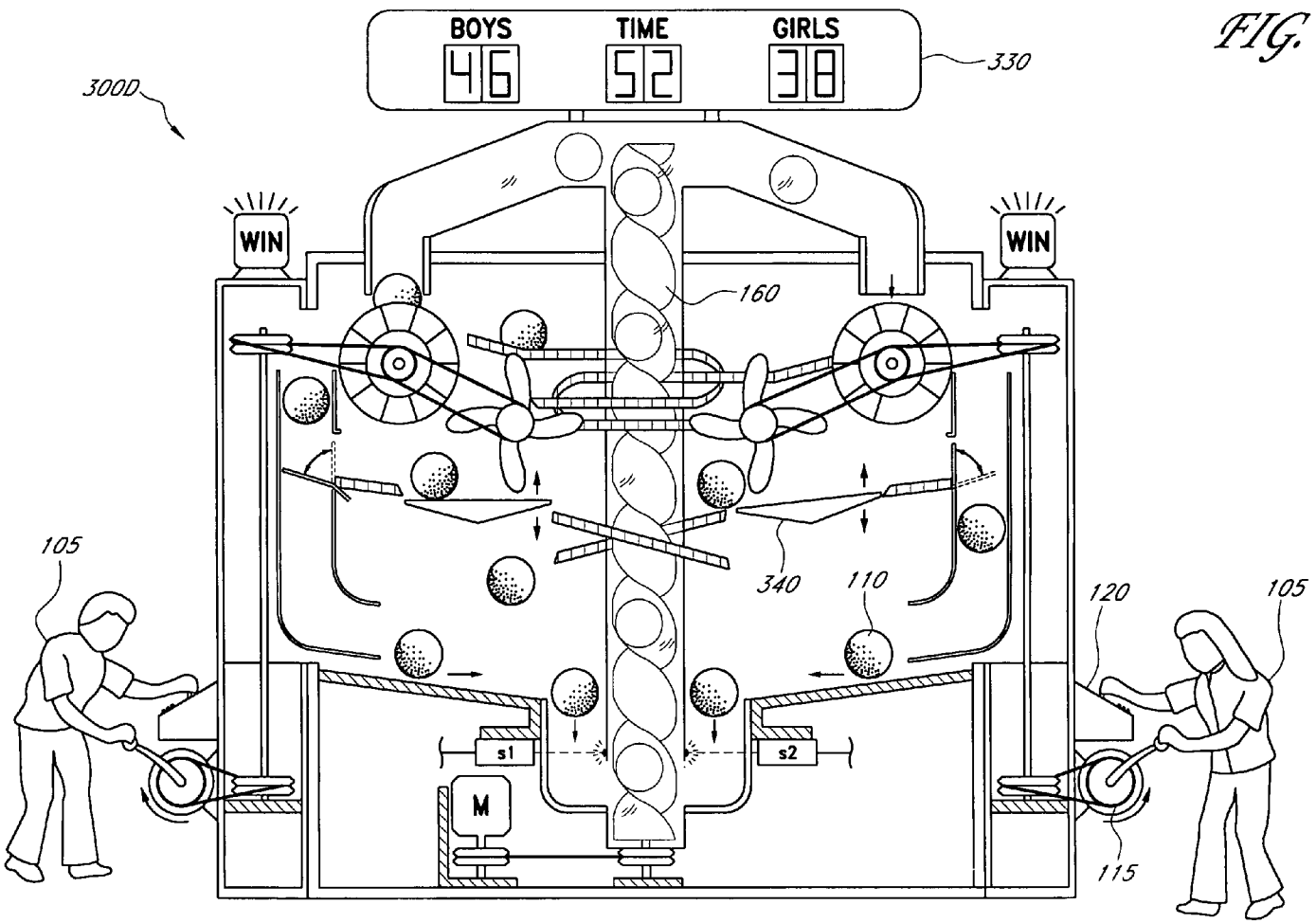
FIG. 7 is a side elevation view of another alternative embodiment of an enclosed and self-contained head-to-head competitive interactive ball maze challenge game incorporating a motorized ball-lift, various remote operated Rube Goldberg devices, and automated scoring.

FIG. 7 is a side elevation view of an enclosed and self-contained head-to-head competitive interactive ball maze challenge game 300D incorporating a motorized ball-lift 160, various remote operated Rube Goldberg devices 340, and automated scoring sensors s1 and s2. In certain embodiments, the game is preferably enclosed, and the balls are contained within clear Plexiglas walls or the like. Opposing players attempt to direct balls 110 through an enclosed Rube Goldberg contraption into specific scoring holes for each side using input controls or buttons on a remote control console 120 and/or hand crank 115 to control each device 340. Preferably, each player has the ability toggle all devices 340 back and forth so each player must react quickly to changed gate settings in an attempt to direct each ball into that player's scoring hole. Points are accorded to each player according to the number of balls directed into each respective scoring hole. Optionally, each ball contains a unique identifier that is read by sensors s1 and s2 to accord different amounts of points per ball. Elapsed time and points awarded are displayed on an overhead scoreboard 330.

Figure 8:
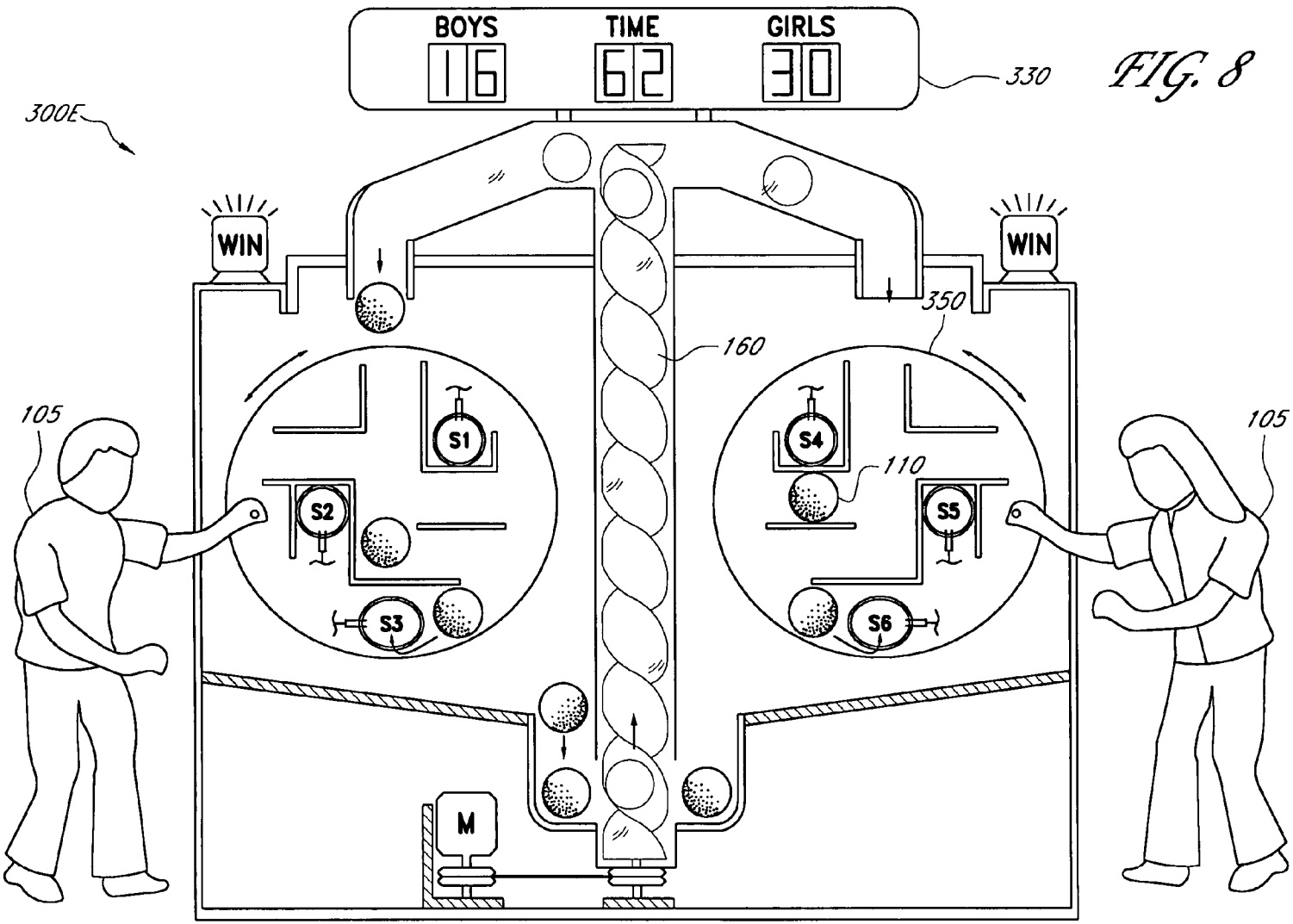
FIG. 8 is a side elevation view of another alternative embodiment of an enclosed and self-contained head-to-head competitive interactive ball maze challenge game incorporating a motorized ball-lift, rotating wheel mazes, and automated scoring.

FIG. 8 is a side elevation view of an enclosed and self-contained head-to-head competitive interactive ball maze challenge game 300E incorporating a motorized ball-lift 160, rotating wheel mazes 350 and automated scoring sensors s1-s6. In certain embodiments, the game is preferably enclosed, and the balls are contained within clear Plexiglas walls or the like. Opposing players 105 attempt to direct balls 110 through an enclosed wheel maze 350 into specific scoring holes by tilting and/or rotating each wheel maze 350 back and forth. Points are accorded to each player according to the number of balls directed into each respective scoring hole. Optionally, each ball contains a unique identifier that is read by at least one of sensors s1-s6 to accord different amounts of points per ball. Elapsed time and points awarded are displayed on an overhead scoreboard 330.

Figure 9:
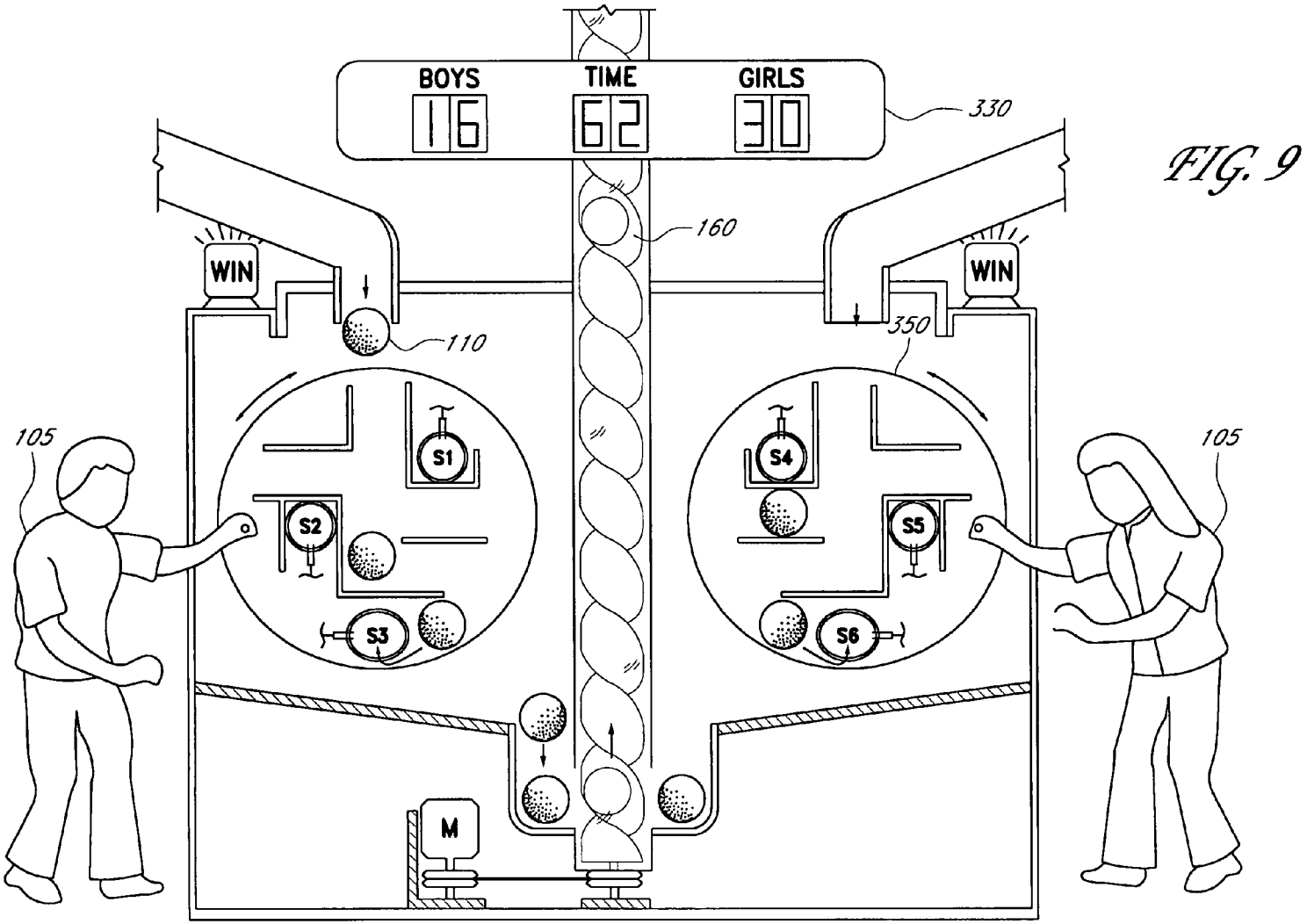
FIG. 9 is a side elevation view of an alternative embodiment of the head-to-head competitive interactive ball maze challenge game of FIG. 8 modified and adapted for use in a larger integrated or non-integrated ball challenge game comprising multiple interactive course-altering inputs and competitive interactive ball challenges.

FIG. 9 is a side elevation view of an alternative embodiment of the head-to-head competitive interactive ball maze challenge game of FIG. 8 modified and adapted for use as a part of a larger integrated or non-integrated ball challenge game comprising multiple interactive course-altering inputs and competitive interactive ball challenges.

Figure 10B:
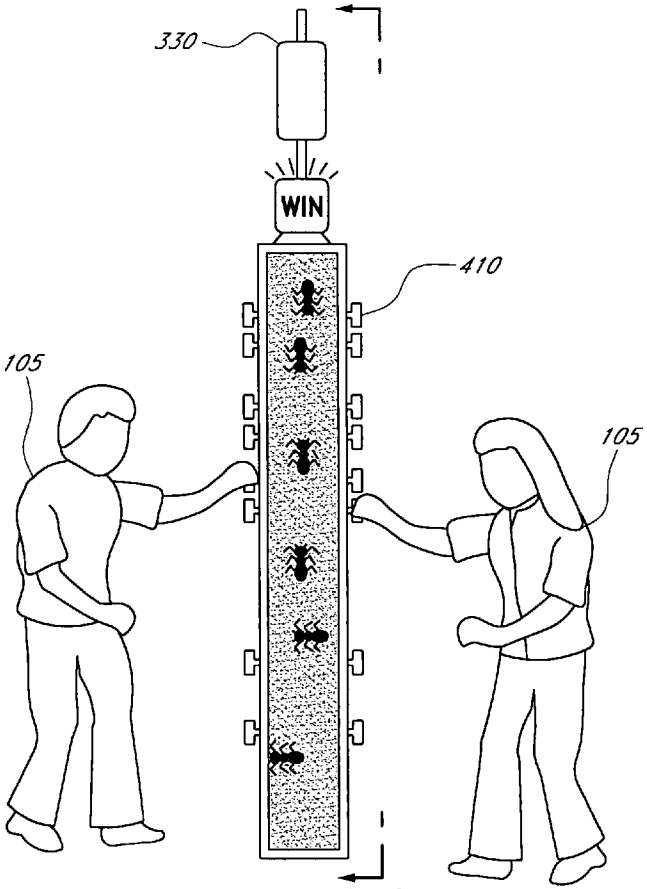
FIG. 10B is a side elevation view of the enclosed and self-contained head-to-head competitive interactive ball maze challenge game of FIG. 10A.
Figure 10A:
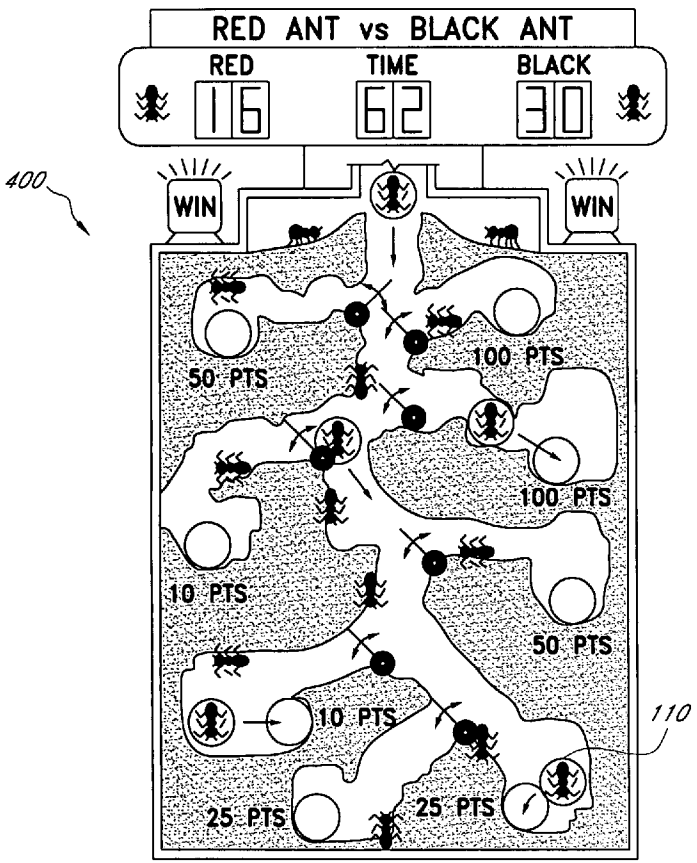
FIG. 10A is a front elevation view of another embodiment of an enclosed and self-contained head-to-head competitive interactive ball maze challenge game in the theme of an insect nest and incorporating direct actuated switch levers, and automated scoring.

FIGS. 10A and 10B are front and side elevation views, respectively, of an enclosed and self-contained head-to-head competitive interactive ball maze challenge game 400 in the theme of an ant colony ("Red Ant vs. Black Ant") and incorporating direct actuated rotating switch levers 410 for controlling ball flow into each of a plurality of scoring holes. In certain embodiments, the game is preferably enclosed, and the balls are contained within clear Plexiglas walls or the like. Opposing players 105 compete to direct each of their corresponding balls 110 (red or black "ants") through the enclosed ant colony and into specific scoring holes by rotating knobs on opposing sides of the game to control various switch levers 410. Preferably, each player has the ability toggle all switches 410 back and forth so each player must react quickly to changed settings in an attempt to direct each ball into that player's scoring hole. Points are accorded to each player according to the number of their balls (e.g., red or black) directed into each respective scoring hole. Preferably, some or all of the balls contain a bar code or other unique identifier that can be read by a sensor or reader (not shown) to distinguish the red from black balls and allocate points to each player accordingly. Elapsed time and points awarded are displayed on an overhead scoreboard 330.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. Thus, it is intended that the scope of the present invention herein disclosed should not be limited by the particular disclosed embodiments described above, but should be determined only by a fair reading of the claims that follow.

What is claimed is:

1. A game play system for facilitating interactive play, the game play system comprising:

a play structure having a plurality of predetermined paths extending from a first common location to a second common location, wherein at least a portion of a first predetermined path of the plurality of predetermined paths comprises a substantially enclosed path;

a plurality of discrete play media, each of the plurality of discrete play media comprising electronic identification information for identifying the respective discrete play media;

at least one game input device in communication with the play structure, whereby the at least one game input device enables at least one play participant to selectively activate a plurality of controls that guide the plurality of discrete play media through one of the plurality of predetermined paths to the second common location, wherein at least one of the plurality of controls is configured to selectively direct at least a portion of the plurality of discrete play media from the first predetermined path to another predetermined path of the plurality of predetermined paths based on activation of the at least one game input device; and at least one reader disposed at or proximate the second common location and configured to wirelessly read the electronic identification information to monitor an amount of the plurality of discrete play media that reaches the second common location within the play structure.

2. The game play system of claim 1, wherein the plurality of discrete play media includes at least one of balls, cubes, plates, flying discs, tubes, and cones.

3. The game play system of claim 1, wherein the at least one game input device includes at least one computer-controlled input.

4. The game play system of claim 1, wherein the at least one game input device includes at least one mechanical input.

5. The game play system of claim 1, further comprising a computing device configured to correlate at least one of the plurality of discrete play media with the at least one play participant based on the electronic identification information read by the at least one reader.

6. The game play system of claim 1, wherein at least one of the predetermined paths comprises at least one of tracks, magnets, runnels, channels and conduits.

7. The game play system of claim 6, wherein at least one of the predetermined paths is configured to utilize gravity or force exertion to transport the plurality of discrete play media.

8. The game play system of claim 1, wherein each of the plurality of discrete play media comprises a radio frequency identification (RFID) tag comprising the electronic identification information.

9. The game play system of claim 8, wherein the RFID tag comprises a passive RFID tag.

10. The game play system of claim 1, wherein the at least one reader comprises a barcode reader.

11. The game play system of claim 1, wherein the play structure further comprises a plurality of second predetermined paths extending from a third location to a fourth location, and wherein the game play system further comprises:

a plurality of second discrete play media;

a second game input device in communication with the play structure, wherein the second game input device enables at least one second play participant to selectively activate a plurality of second controls that transport the plurality of second discrete play media through one of the plurality of second predetermined paths to the fourth location; and a second reader disposed at or proximate the fourth location and configured to wirelessly monitor an amount of the plurality of second discrete play media that reaches the second location within the play structure.

12. The game play system of claim 11, wherein at least two of the plurality of predetermined paths share a common portion.

13. A method of competitive game play for play participants, the method comprising:

receiving substantially simultaneous access by at least a first play participant and a second play participant to a play system, wherein the play system comprises:

at least a first game input and a second game input;

a plurality of discrete play media; and at least one desired destination for the discrete play media;

receiving a first control signal from the first game input to affect the transport of a first portion of the plurality of discrete play media through a first predetermined path of a first plurality of predetermined paths of the play system to the at least one desired destination;

receiving a second control signal from the second game input to affect the transport of a second portion of the plurality of discrete play media through a second predetermined path of a second plurality of predetermined paths of the play system to the at least one desired destination; and determining a success of the first play participant based on an amount of the first portion of the plurality of discrete play media transported to the at least one desired destination and a success of the second play participant based on an amount of the second portion of the plurality of discrete play media transported to the at least one desired destination, said determining comprising wirelessly reading electronic identification information associated with each of the first and second portions of the plurality of discrete play media.

14. The method of claim 13, further comprising determining at least one winning play participant and presenting the at least one winning play participant with a reward.

15. The method of claim 13, further comprising displaying on a visible display the determined success of the first and second play participants in transporting the first and second portions of the plurality of discrete play media to the at least one desired destination.

16. A method of competitive game play for play participants, the method comprising:

accessing a play system, wherein the play system comprises:

a plurality of discrete play media, each of the plurality of discrete play media comprising identification information; and at least one game input configured to enable a plurality of players to substantially simultaneously selectively control transport of the plurality of discrete play media through at least one of a plurality of preconfigured paths of the play structure to at least one desired destination;

utilizing the at least one game input to selectively control the transport of the plurality of discrete play media to the at least one desired destination;

electronically reading the identification information from each of the plurality of discrete play media at or near the at least one desired destination; and associating, based on said electronically reading, a first amount of a first portion of the plurality of discrete play media with a first player of the plurality of players; and associating, based on said electronically reading, a second amount of a second portion of the plurality of discrete play media with a second player of the plurality of players.

17. The method of claim 16 wherein the at least one game input comprises a computer-controlled input.

18. The method of claim 16, wherein said electronically reading comprises receiving a radio frequency identification (REID) signal from each of the plurality of discrete play media.

19. The method of claim 18, wherein each of the plurality of discrete play media comprises a passive REID tag for storing the identification information.

20. The method of claim 16, wherein said electronically reading comprises reading a barcode from each of the plurality of discrete play media.

* * * * *